United States Patent [19]

Rivera

[11] Patent Number: 4,884,673

[45] Date of Patent: Dec. 5, 1989

[54] CURVED ESCALATOR WITH FIXED CENTER CONSTANT RADIUS PATH OF TRAVEL

[75] Inventor: James A. Rivera, Bristol, Conn.

[73] Assignee: Otis Elevator Company, Farmington, Conn.

[21] Appl. No.: 328,934

[22] Filed: Mar. 27, 1989

[51] Int. Cl.[4] ..... B66B 21/02

[52] U.S. Cl. ..... 198/328; 198/778; 198/845

[58] Field of Search ..... 198/328, 334, 831, 778, 198/845

[56] References Cited

U.S. PATENT DOCUMENTS

| | | | |
|---|---|---|---|
| 617,779 | 1/1899 | Seeberger . | |
| 685,019 | 10/1901 | Venn . | |
| 723,325 | 3/1903 | Souder . | |
| 727,720 | 5/1903 | Venn . | |
| 782,009 | 2/1905 | Dodge . | |
| 967,710 | 8/1910 | Bennett . | |
| 984,495 | 2/1911 | Seeberger . | |
| 984,858 | 2/1911 | Seeberger . | |
| 999,885 | 8/1911 | Seeberger . | |
| 1,023,443 | 4/1912 | Seeberger . | |
| 2,695,094 | 11/1954 | Riley . | |
| 2,823,785 | 2/1958 | Hefti . | |
| 3,878,931 | 4/1975 | Luna . | |
| 4,662,502 | 5/1987 | Nakatami | 198/328 |
| 4,726,460 | 2/1988 | Otomo | 198/328 |
| 4,730,717 | 3/1988 | Sugita | 198/328 |
| 4,739,870 | 4/1988 | Saito | 198/328 |
| 4,746,000 | 5/1988 | Nakatami et al. | 198/328 |

FOREIGN PATENT DOCUMENTS

| | | |
|---|---|---|
| 3441845A1 | 6/1985 | Fed. Rep. of Germany . |
| 48-25559 | 7/1973 | Japan . |
| 58-220077 | 12/1983 | Japan . |
| 292641 | 6/1928 | United Kingdom . |

*Primary Examiner*—Robert J. Spar
*Assistant Examiner*—D. Glenn Daydan
*Attorney, Agent, or Firm*—William W. Jones

[57] ABSTRACT

An escalator is provided with a curved path of travel from its entry to its exit landings. The path of travel of the escalator steps as seen in plan is a curve having a fixed center and a constant radius from landing to landing. In elevation, each landing portion will be disposed in vertically spaced horizontal planes, and there will be a medial constant slope ascending or descending portion. Interconnecting each landing portion with the constant slope portion will be entry and exit transitional curved portions of varying slope as seen in the elevational view. To enable the steps to traverse the curved path successfully, the effective length of at least one of the step chains is varied at different points along the path of travel of the escalator.

7 Claims, 4 Drawing Sheets

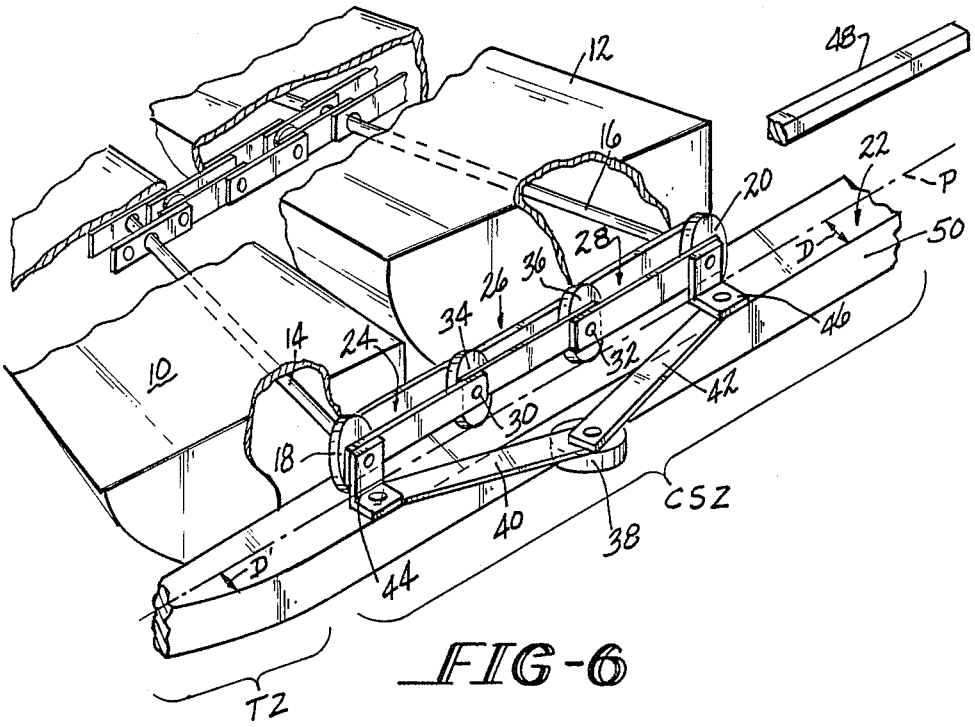
FIG-6
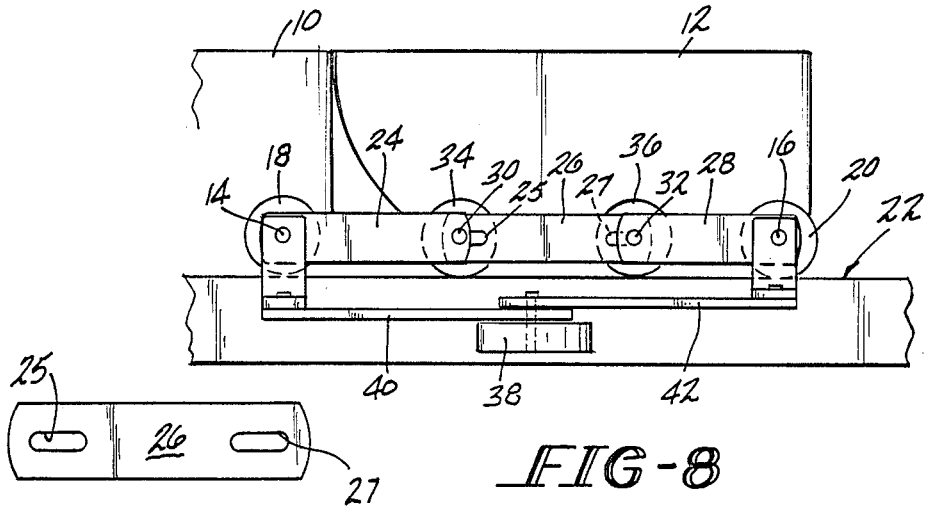
FIG-8
FIG-7

CURVED ESCALATOR WITH FIXED CENTER CONSTANT RADIUS PATH OF TRAVEL

TECHNICAL FIELD

This invention relates to a curved escalator construction, and more particularly to a curved escalator having a path of travel defined by a fixed center, constant radius arc when viewed in plan.

BACKGROUND ART

Escalators which follow a curved path of travel from entry landing to exit landing are generally known in the prior art. There are two general approaches which have been taken in the prior art to designing an operable curved escalator. One approach involves the use of a path of travel which, in plan, is defined by an arc having varying radii of curvature and emanating from a shifting center. The other approach involves the use of a path of travel which, in plan, is defined by an arc of constant radius struck from a fixed center.

Patent publications which relate to the aforesaid first approach include: Japanese Patent Publication 4825559 of July, 1973; German Patent Publication 3,441,845, June 13, 1985; U.S. Pat. No. 4,662,502, Nakatani et al, granted May 5, 1987; and U.S. Pat. No. 4,746,000, Nakatani et al, granted May 24, 1988.

Patent publications which relate to the aforesaid second approach include: U.S. Pat. Nos. 685,019, Oct. 22, 1901; 723,325, Mar. 24, 1903; 727,720, May 12, 1903; 782,009, Feb. 7, 1905; 967,710, Aug. 16, 1910; 2,695,094, Nov. 23, 1954; 2,823,785, Feb. 18, 1958; 3,878,931, Apr. 22, 1975; 4,726,460, Feb. 23 1988; 4,730,717, Mar. 15, 1988; 4,739,870, Apr. 26, 1988; British Pat. No. 292,641, June 22, 1928; and Japanese Patent Disclosure No. 58-220077, 1983.

Japanese Patent Disclosure No. 58-220077, dated Dec. 21, 1983 discloses a curved escalator which has a constant radius, fixed center arcuate path of travel when viewed in plan. When the treads of the escalator move from the horizontal landing to the constant slope intermediate zone, they are properly repositioned by accelerating and decelerating their inside edges in the transition zones adjacent the landings. The differential movement of the inside tread edges is accomplished with pivoting links which interconnect the step axles of adjacent steps and which are joined at pivot points provided with rollers that traverse a track. The step axles also have rollers at their inside ends which travel over another track vertically spaced from the link roller track. The position of the inside edges of the steps is varied in the transition zone by varying the vertical distance between the inside step axle roller track and the link roller track beneath it. The links lengthen in the constant slope portion of the escalator and shorten in the horizontal landing and turn around zones. The steps are engaged by driving chains which connect to the step axles only in the constant slope zone where the position of the steps relative to each other remains constant. The drive chains do not contact the step axles in the transition, landing, or turn around zones. Varying the position of the inside edge of the steps requires that the connecting links be shortened in the horizontal and turn around zones of the escalator, and the use of two separate tracks for the inside step axle roller and for the adjustment link rollers, requires that the adjustment links will always be skew throughout the entire path of travel of the escalator. The use of two separate axle roller and link roller tracks also requires that the drive housing and tread reverse sprockets be vertically elongated.

Charles D. Seeberger was a turn-of-the-century inventor who obtained U.S. Pat. Nos. 617,778, granted Jan. 17, 1899; 617,779, granted Jan. 17, 1899; 984,495, granted Feb. 14, 1911; 984,858, granted Feb. 21, 1911; and 999,885, granted Aug. 8, 1911, which all relate to curved escalators. The 617,779 patent discusses the need to shorten and lengthen step chains in a curved escalator having a path of travel which has portions with different radii. The step chains are formed with segments which are threadedly connected to each other. The segments are rotated by a pinion mechanism to unscrew, or tighten the threaded connections whereby the chain is lengthened or shortened when necessary. The 984,495 patent states that a curved escalator with a fixed radius, constant center cannot have both ends of adjacent step axles connected to each other by links of fixed length. A scissor connection is then made between succeeding axles, and a slight adjustment of this connection is made when the steps move from the curved horizontal track section to the inclined curved section of the track. The adjustment is described at Page 3, line 119 to Page 4, line 28 of the patent. The 999,885 patent describes a curved escalator having its steps connected together at their inner and outer edges, with the outer edge connection being of constant length, and the inner edge connection being variable by reason of adjustable links.

DISCLOSURE OF INVENTION

This invention relates to a step chain and track assembly for use in a curved or spiral escalator of the type having a fixed center, constant radius arcuate path of travel when viewed in plan. The assembly of this invention takes into account that in the escalator of the type specified, the steps, as they pass from the horizontal landing entry area into and through the entry transitional area to the constant slope area, will have to pivot with respect to each other in order to have their tread surfaces remain horizontal. This pivoting movement is accomplished by moving the outer side of the steps at a different angular velocity than the inner side of the steps as the latter move through the entry transition zone and through the constant slope zone when viewed in plan. In the exit transition zone, the differential movement of the inner and outer sides of the steps is reversed so that the steps then pivot back to their original orientation relative to each other. Thus the velocities of the steps and their angular positions will vary at different locations along the path of movement thereof. In order to allow the pivotal step movement without binding the steps together, the step risers will be formed with a modified conical configuration, the details or specifics of which will be determined by the radius of curvature of the path of travel of the escalator, and the size of the step.

The differential velocity and pivotal movement of the steps is accomplished in the assembly of this invention preferably by changing the effective length of the outer step chain without changing the length of its individual links. It should be noted that the actual length of the step chain is not altered, but only its effective length is changed. The step chains consist of a plurality of links which are pivotably connected together and which are also connected to the roller axles on the steps. Each of the chain link pivot connections carries a chain roller, as will be described in greater detail hereinafter. The step roller axles carry rotating rollers which move on tracks mounted beneath the steps, in a known manner. In the assembly of this invention, the outermost of the tracks along which the step rollers move is a contoured track, which in the constant slope portion of the escalator path consists of a predetermined constant width track along which all of the chain rollers move. In the constant slope portion of the escalator path, the outer step chain will have a first shortened effective length, and thus the adjacent step axles will be separated by a first shortened predetermined distance. In the horizontal portion of the escalator path, the track has a reduced width. Between the two track portions, are transitional zones where the track width gradually changes from the reduced width to the enlarged width, and return. The width of the outer track is changed preferably by profiling the outer side of the track so as to convert the outer side surface of the track into a cam track. A cam roller which travels over the outer track cam track is provided on the outer side for each successive pair of steps. Each cam roller is connected to successive step axles by means of scissor links and anchor brackets. The chain link joints between successive step axles are elongated so that relative sliding movement of the adjacent chain links can occur. As the cam roller moves over the cam track on the wider portion, i.e., the constant slope zone of the track, the cam roller will move outwardly away from the step chain causing the scissor links to close up. This causes the intermediate links to slide toward each other so as to shorten the effective distance between adjacent step axles in the constant slope zone of the escalator. The outer step chain thus shortens in the constant slope so as to realign the step properly. In the horizontal, narrower track zones, the cam rollers will have moved back toward the step chain causing the scissor links to open up pushing the adjacent step axles away from each other. Thus, the outer step chain will have its longest effective length in the horizontal landing zones. The rate of change between the two track conditions determines the rate of change of the effective chain length, and thus the rate of change of the step velocity. In accordance with this invention, in the entry transitional zone, i.e., the transitional zone between the entry landing and the constant slope portion of the escalator, the effective length of the outside chain will shorten, and the reverse will happen in the exit transitional zone which connects the constant slope portion of the escalator with the exit landing.

It is therefore an object of this invention to provide an escalator-driving step chain and track assembly for use in a curved escalator having a fixed center and constant radius path of travel when viewed in plan.

It is an additional object of this invention to provide an assembly of the character described wherein the steps of the escalator are pivoted with respect to each other as the steps move to or from horizontal landing zones from or to a constant slope intermediate zone.

It is a further object of this invention to provide an assembly of the character described wherein the pivotal movement of the steps is accompanied by a change in the angular velocity of the outer edges of the steps when viewed in plan.

It is another object of this invention to provide an assembly of the character described wherein the effective length of the outer step chain is changed as the steps move between landing zones and the intermediate constant slope zone so as to change the distance between step axles on adjacent steps on the escalator.

It is yet an additional object of this invention to provide an assembly of the character described wherein the effective length of the step chain is changed by selectively sliding the links of the chain toward and away from each other.

These and other objects and advantages of the invention will become more readily apparent from the following detailed description of the invention when taken in conjunction with the accompanying drawings in which:

BRIEF DESCRIPTION OF THE DRAWINGS

FIG. 6 is a perspective fragmented view of an embodiment of a step chain and track assembly formed in accordance with this invention;

FIG. 7 is a side elevational view of one of the intermediate links in the chain;

FIG. 8 is a side elevational view showing the assembly on the horizontal landing zone of the track illustrating how the effective length of the step chain is lengthened.

BEST MODE FOR CARRYING OUT THE INVENTION

Figure 1:
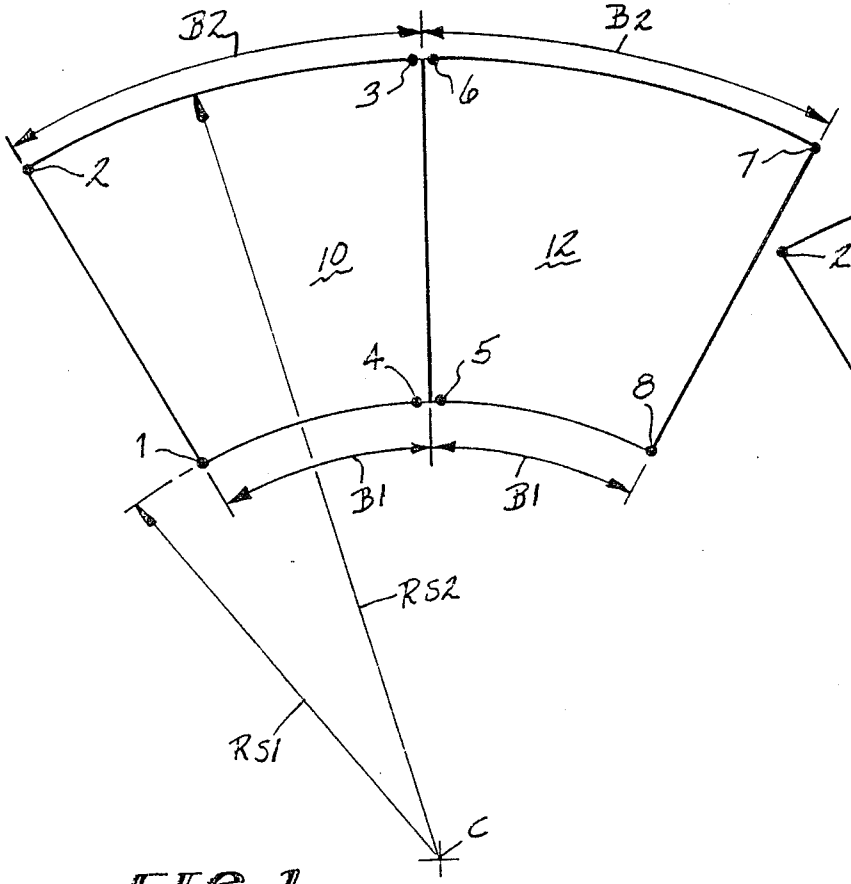
FIG. 1 is a plan view of the steps of the escalator as they appear in the horizontal landing zones of the escalator.

Referring now to FIG. 1, there are shown two steps 10 and 12 on the escalator as they would appear in plan view looking down on the treads in one of the horizontal landing zones. The steps 10, and 12 have constant arcuate inner sides of radius RSl along which points I, 4, 5 and 8 lie, and constant arcuate outer sides of radius RS2 along which points 2, 3, 6 and 7 lie. The radii RS1 and RS2 are struck from a fixed center C. The inner step chain has an incremental length B1 for each step 10 and 12, and the outer step chain has an incremental length B2 for each step 10 and 12.

Figure 2:
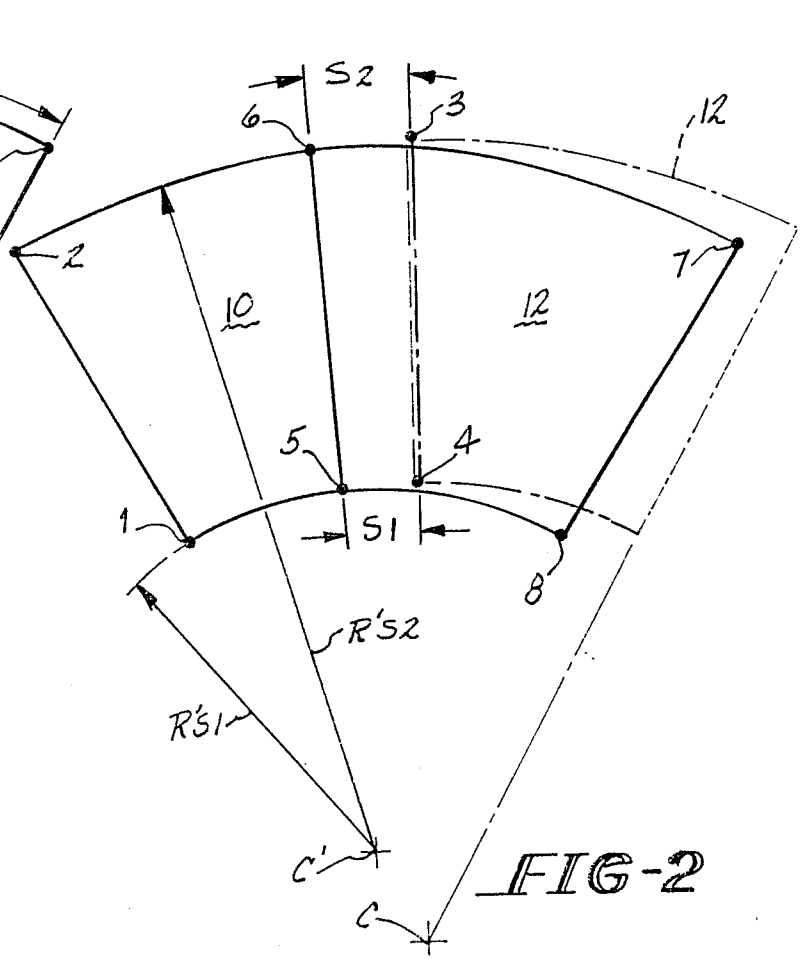
FIG. 2 is a plan view similar to FIG. 1 but showing the pivotal movement that the steps would undergo in the constant slope intermediate zone if the inner and outer step chains were kept at a constant effective length.

Referring to FIG. 2, the positions of the steps 10 and 12 are illustrated as they would appear in the intermediate constant slope incline zone of the escalator if the effective incremental lengths B1 and B2 of the inner and outer step chains were kept constant. The position of the step 12 in the landings is shown in FIG. 2 in phantom and the position of the step 12 in the incline is shown in solid lines. When the steps 10 and 12 are in the inclined zone of the escalator, assuming that step 12 is the higher step, it will have pivoted up and over the step 10 so that point 6 will have moved a distance S2 and point 5 will have moved a distance S1. This movement of the step 12 will cause the apparent radius of the inner side sections of the steps 10 and 12 to decrease to R'S1 and the apparent radius of the outer side sections of the steps 10 and 12 to decrease to R'S2 both of which will be struck from a center point C' which is offset from the original center point C.

Figure 3:
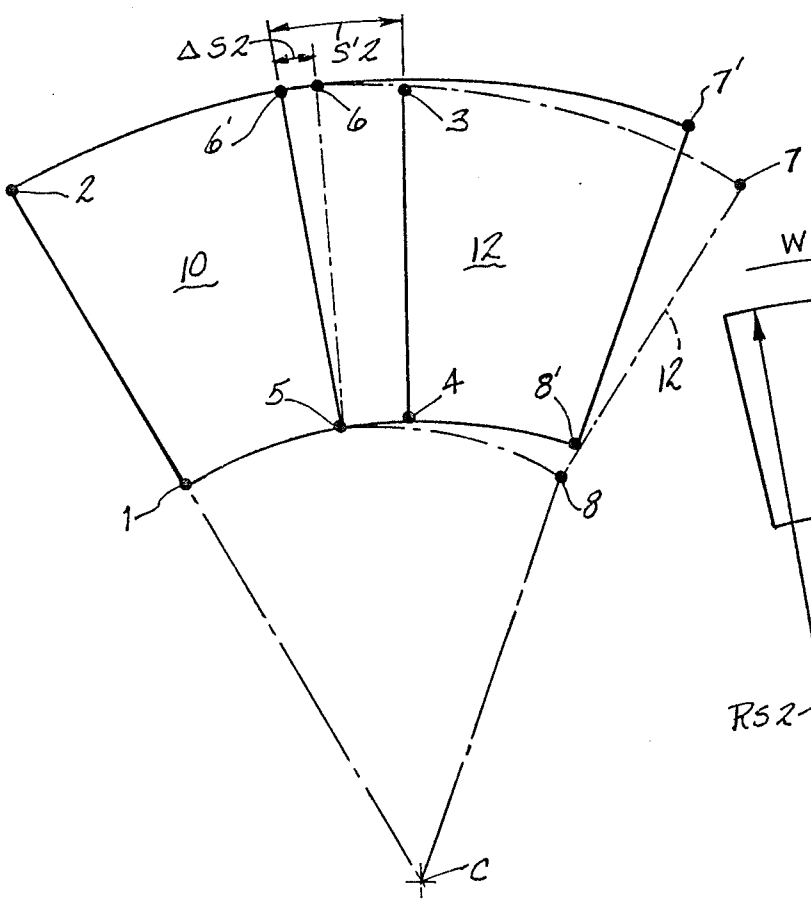
FIG. 3 is a plan view similar to FIG. 2, but showing the pivoted position of the steps in the intermediate zone when the effective length of the outside step chain is shortened while maintaining constant the effective length of the inside step chain.

In order to counter this tendency of the steps 10 and 12 to spiral into a tighter radius path of travel, and to maintain the original radial path of travel, the step 12 must be pivoted an additional increment over the step 10 when the steps are in the intermediate inclined zone of the escalator path. In FIG. 3, the position of step 12 from FIG. 2 is shown in phantom, and the desired position needed to provide the constant radius is shown in solid lines. To achieve the desired position, the outside of the step 12 is further pivoted a distance ΔS2 so that the corners 6, 7 and 8 of the step 12 shift to positions 6', 7' and 8' respectively. The corner 5 of the step 12 can be considered as forming the pivot point and thus does not substantially shift its position. It will be appreciated that the radii described above are actually the step chain radii, but for purposes of explaining the step movement, they can be considered to be the radii of the path of movement of the inner and outer edges of the steps.

As noted, to make a constant plan radius curved escalator, the distance between point 2 and point 6 needs to get smaller while maintaining the distance between point 1 and point 5. A pivoting motion about point 5 is the result. This is done by shortening the length of the outer step chain as it goes through the entry transition zone. The result thereof is shown in FIG. 3.

The following equations can be used to calculate the required shortening of the outer step chain:

$$S1 = B1\,(1 - \cos \alpha\, s1) \qquad \text{eq. 1}$$

$$S2 = B2\,(1 - \cos \alpha\, s2) \qquad \text{eq. 2}$$

$$S'2 = \frac{Rs2}{Rs1}\,(S1) \qquad \text{eq. 3}$$

$$\Delta S2 = S'2 - S2 \qquad \text{eq. 4}$$

$$B'2 = \frac{B2 \cos \alpha\, s2 - \Delta S2}{\cos \alpha\, s2} \qquad \text{eq. 5}$$

where

Rs1=plan radius inner step track;
Rs2=plan radius outer step track;
B1=incremental chain length inner step;
B2=incremental chain length outer step;
B'2=incremental chain length outer in transition/incline section;
αs1=angle of inclination inner step track;
αs2=angle of inclination outer step track;
S1=arc length projection inner step;
S2=arc length projection outer step;
S'2=arc length projection outer step which will pivot the step onto the constant radius; and
ΔS2=delta arc length projection outer step which will pivot the step onto the constant radius.

VELOCITY

Figure 5:
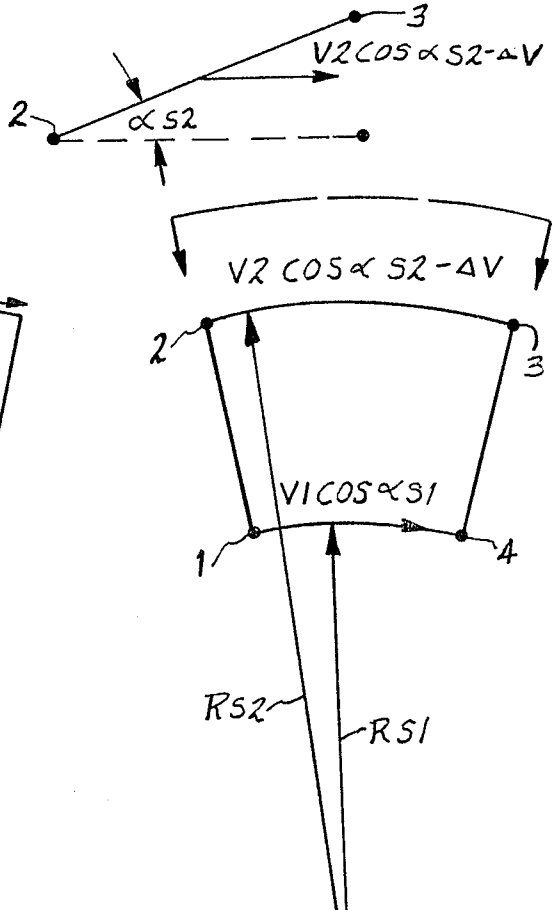
FIGS. 4 and 5 are schematic views of the steps in the landing and inclined portions respectively showing how velocities can be related to step positions.
Figure 4:
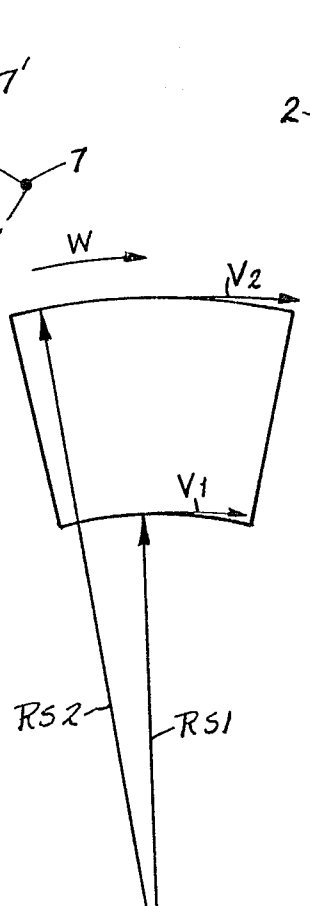

The following equations show how the velocities will be related to the step positions as shown in FIGS. 4 and 5, wherein:

V1=tangential velocity inner step edge;
V2=tangential velocity outer step edge;
W=angular velocity;
Rs1=plan radius inner step track;
Rs2=plan radius outer step track;
αs1=angle of inclination inner step track;
αs2=angle of inclination outer step track;
B1=incremental chain length inner step;
B2=incremental chain length outer step; ΔS2=delta arc length projection outer step which will pivot the step onto the constant radius; and
ΔV=delta velocity subtracted from outer step in the plan view.

For the horizontal section which is shown in FIG. 4, the following equations apply.

V1=W X Rs1
V2=W X Rs2
V1/V2=Rs1/Rs2=constant K
Rs1/Rs2=B1

For the transition section and incline section which is shown in FIG. 5, the following equations apply.

$$\frac{V1 \cos \alpha\, s1}{V2 \cos \alpha\, s2} \neq \frac{Rs1}{Rs2} = K$$

$$\frac{B1 \cos \alpha\, s1}{B2 \cos \alpha\, s2} \neq \frac{Rs1}{Rs2} = K$$

To vary the velocity of the outside step edge and vary the outside axle distance the following equations apply.

$$\frac{V1 \cos \alpha\, s1}{V2 \cos \alpha\, s2 - \Delta V} = \frac{Rs1}{Rs2} = \frac{B1 \cos \alpha\, s1}{B2 \cos \alpha\, s2 - \Delta S2}$$

whereupon ΔV can be calculated as follows:

$$\Delta V = V2 \cos \alpha\, s2 - \frac{Rs2}{Rs1}\,(V1 \cos \alpha\, s1).$$

Figure 9:
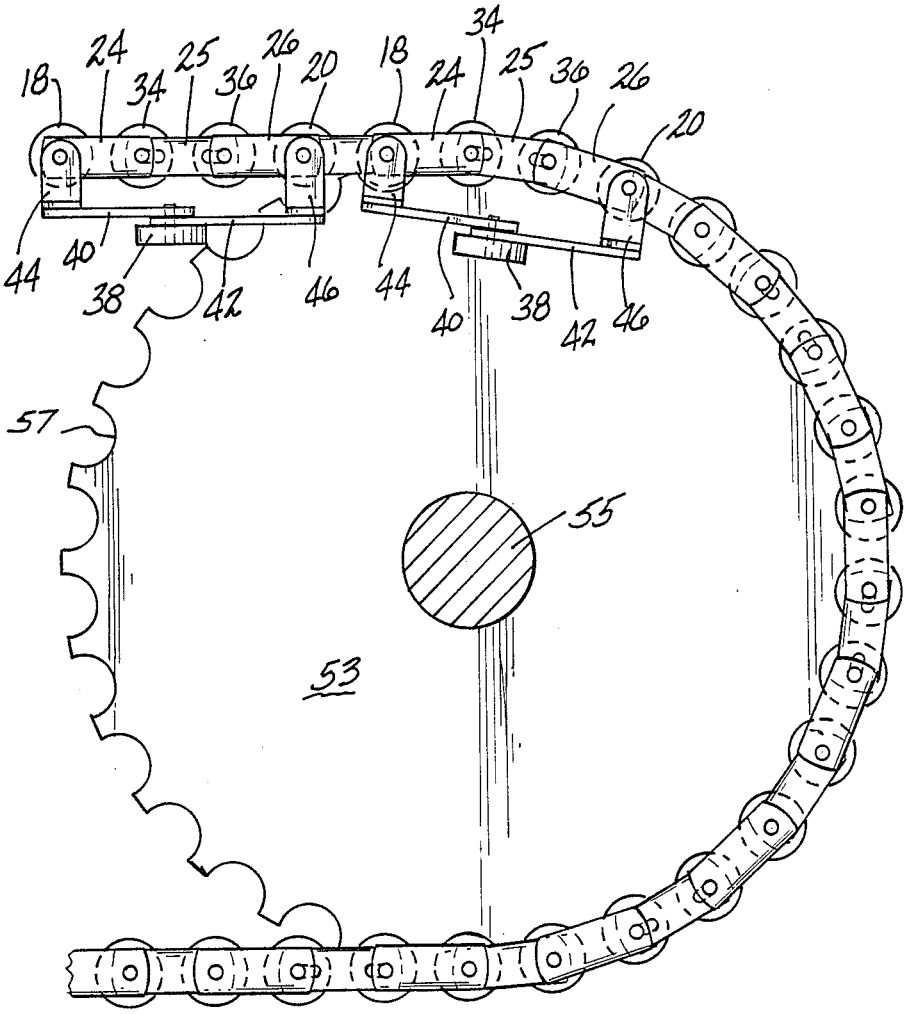
FIG. 9 is an elevational view of the turn around sprocket of the step chain of FIG. 6.

Referring now to FIGS. 6–9, there is shown a first embodiment of a step chain and track assembly which is operable to effect the aforesaid changes in the effective length of the outer step chain, and in the velocity of the outer side of the steps 10 and 12, which are shown schematically in FIGS. 8 and 9. In FIG. 6 the step chain is shown as it appears on the intermediate constant slope portion of the escalator. What is shown is one segment of the step chain that interconnects adjacent step axles 14 and 16. The step axle 14 is mounted on the step 10 and the axle 16 is mounted on the step 12. The step axles 14 and 16 carry rollers 18 and 20 respectively which roll along the track 22. The chain segment shown includes three link sets 24, 26 and 28 which are pivotally connected to the step axles 14 and 16 respectively, and are also connected to rotation axles 30 and 32 of a pair of intermediate chain rollers 34 and 36. The intermediate chain roller axles 30 and 32 are also pivotally journaled to opposite ends of the chain link 26. As shown in FIG. 7, the links 26 are provided with elongated slots 25 and 27 at each end thereof through which the intermediate chain roller axles 30 and 32 pass. These elongated slots allow the links 24 and 28, and therefore the step axles 14 and 16 to move toward and away from each other.

A camming roller 38 is journaled on adjacent ends of the scissor links 40 and 42 which have their opposite ends pivotably connected to L-shaped brackets 44 and 46 which are mounted at the distal ends of chain links 24 and 28. An outer upthrust track 48 is disposed above the rollers 18, 20, 34 and 36 for engagement thereby to counter upthrust forces imparted to the chain during operation of the escalator, as is shown in FIG. 6.

An inner step chain 32 connects inner ends of the step axles 14 and 16, the inner step chain 32 being of relatively conventional construction and having a constant effective length which equals its actual length.

As shown in FIG. 6, the chain segment interconnecting steps 10 and 12 is positioned on the constant slope inclined intermediate zone of the track 22. The camming roller 38 travels over the outer side surface 50 of the outer track 22 and is urged thereagainst by inwardly directed side thrust forces created by operation of the escalator. The side surface 50 of the track 22 of profiled so as to form a camming surface or track for repositioning the steps during passage of the escalator along its curved path of travel. The phantom line P in FIG. 6 illustrates the curved path of travel that the rollers 18, 20, 34 and 36 follow along the track 22. The portion of the track 22 described by the bracket CSZ is the constant slope zone of the path of travel. Throughout this zone, the distance D from the outer side surface 50 of the track to the path P remains constant and relatively large. Thus, the camming roller 38 will be held away from the path P and the scissor links 40 and 42 will urge the chain link sets 24 and 28 toward each other to shorten the effective length of the chain, and to shorten the distance between the step axles 14 and 16 in the constant slope zone. In the transition zone of the track 22, which is identified with the bracket TZ in FIG. 6, the side surface 50 of the track 22 is angled to form a ramp which moves toward the roller path P. Thus, when the cam roller 38 moves through the transition zone TZ, the roller 38 will move toward the roller path P causing the scissor links 40 and 42 to spread apart. This causes the chain link sets 24 and 28, and the step axles 14 and 16 to move away from each other. This increases the distance between the outside ends of the step axles 14 and 16. In the horizontal landing zones, the side surface 50 of the track 22 is disposed closely adjacent to the roller path P whereby the step axles 14 and 16 remain in their farthest spaced apart positions.

It will be appreciated that when travelling from entry landing to exit landing, the step chain starts with a longer effective length which shortens in the entry transition zone, remains shortened in the constant slope zone, and then lengthens back to the original effective length in the exit transition zone. This shortening and lengthening of the distance between step axles is what properly positions the steps and keeps them travelling in a constant radius fixed center arcuate path, when viewed in plan.

As seen from FIG. 9, when the chain links 24, 26, 28 are all aligned in the horizontal landing zones, they will pass easily over the turn around sprocket 53 at the entry and exit of the escalator. The sprocket 53 is mounted on a driven shaft 55 and is disposed at one of the landing ends of the escalator. It will be appreciated that the escalator is thus of conventional construction wherein the return path of the steps lies beneath the passenger-carrying path. The sprocket 53 is formed with enlarged circumferential recesses 57 which are sized so as to receive and carry the rollers 18, 20, 34 and 36 of the driven step chain. The camming rollers 38 travel to one side of the rocket 53 as the chain and steps reverse their path of travel. It will be appreciated that there will be two reversing sprockets, one at each end of the escalator, but only one of which will be a drive sprocket. The other sprocket will be formed as shown but will serve as an idler sprocket which merely guides the chain but does not drive it.

It will be readily understood that the step chain and track assembly of this invention allows the escalator path of travel to be defined by a constant radius arc derived from a fixed center point. This in turn allows for greater control of step-to-step, and step-to-skirt gaps in the escalator. Balustrades, tracks and skirts can be more easily formed and accurately installed. Additionally, the step pivoting feature of the invention assures a relatively simple mechanical form which eliminates the complex step connections described in the aforesaid prior art. The movement of the steps is completely controlled at all points in the path of travel of the escalator, and may be customized to accommodate different sweep angles, angles of inclination, and rise distances for the escalator.

It will be appreciated that the adjustments in effective chain lengths must be made in the outer step chain so that the chains will be fully elongated when they contact the turn around sprockets.

Since many changes and variations of the disclosed embodiments of the invention may be made without departing from the inventive concept, it is not intended to limit the invention otherwise than as required by the appended claims.

I claim:

1. An escalator assembly having an arcuate path of travel defined by a constant radius derived from a fixed center as viewed in plan, the escalator including horizontal entry and exit landing zones, an intermediate constant slope zone, and entry and exit transition zones of continuously varying slope interconnecting the constant slope zone with the entry and exit landing zones respectively, said escalator assembly including:

(a) track means extending between said landing zones and through said transition and constant slope zones for guiding movement of steps along the path of travel of the escalator;

(b) a plurality of steps, each having: an upper tread portion which remains substantially horizontal throughout a passenger transporting portion of the path of travel of the escalator; a step axle at radially inner and outer sides of each step; radially inner and outer step axle rollers rotatably mounted on said step axles, said step axle rollers being operable to travel over radially inner and outer portions of said track means;

(c) radially inner and outer step chains forming a continuous connection between said step axles whereby all of said steps are connected together at both their inner and outer sides throughout the entire path of travel of the escalator; and (d) camming means for continuously changing the effective length of the outer one of said step chains as the steps move through each of said transition zones so as to move the step axles of adjacent steps toward and away from each other by sliding selected links on said outer step chain toward and away from each other while retaining all of the links in the outer step chain in substantially linear alignment with each other said camming means being operably connected to successive pairs of said outer step axles; and said selected links being adjacent links interposed between each of said successive pairs of said outer step axles, said camming means being operable to move said outer step axles in each successive pair thereof closer together, as said steps move through said entry transition zone, by sliding said selected links toward each other; said camming means further being operable to hold said outer step axles in each successive pair thereof closer together as said steps move through said constant slope zone; and said camming means being operable to move said outer step axles in each successive pair thereof further apart in said exit transition zone by sliding said selected links away from each other, said camming means being operable to hold said outer step axles in each successive pair thereof further apart in each of said entry and exit landing zones and said camming means comprising a cam roller operably connected to each outer step axle in each successive pair thereof; and a profiled cam path which said cam roller follows whereby said cam roller causes relative convergent and divergent movement of said outer step axles at different points on said cam path.

2. The escalator assembly of claim I wherein said cam roller is operably connected to said outer step axles by means of scissor links which are pivotably connected to said outer step axles and to said cam roller, said scissor links being operable to open and close responsive to movement of said cam roller along said cam path whereby the movement of said outer step axles is accomplished.

3. The escalator assembly of claim 2, wherein said cam path is formed on an outside side surface of said outer portion of said track means.

4. The escalator assembly of claim 3 wherein one of said selected links includes an elongated slot for connection with an adjacent link to allow said sliding movement of said one selected link with respect to said adjacent link.

5. An escalator assembly having an arcuate path of travel defined by a constant radius derived from a fixed center as viewed in plan, the escalator including horizontal entry and exit landing zones, an intermediate constant slope zone, and entry and exit transition zones of continuously varying slope interconnecting the constant slope zone with the entry and exit landing zones respectively, said escalator assembly including:

(a) track means including an outer track extending between said landing zones and through said transition and constant slope zones for guiding movement of steps along the path of travel of the escalator;

(b) a plurality of steps, each having: an upper tread which remains substantially horizontal throughout a passenger transporting portion of the path of travel of the escalator; a step axle having an outer end at an outer side of each step; outer step axle rollers journaled on said step axles, said outer step axle rollers being operable to travel over said outer track along a predetermined path thereon;

(c) an outer step chain forming a continuous connection between said outer ends of said step axles throughout the entire path of travel of the escalator, said outer step chain including selected links thereon interposed between said step axles in successive pairs thereof, said selected links being adapted to slide axially with respect to other links in said outer step chain whereby the distance between said outer ends of said step axles on successive steps can be selectively increased and decreased from place to place along the path of travel of the escalator; and (d) camming means including a cam path; a plurality of cam followers movable along said cam path; and scissor means interconnecting each of said cam followers with each of said outer ends of said step axles in each successive pair thereof; said cam path including a first portion spaced closely to said predetermined path in said landing zones; a second portion spaced further away from said predetermined path in said constant slope zone; and varying ramp portions which interconnect said first and second portions in said transitional zones whereby movement of said cam follower along said cam path is operable to hold adjacent outer ends of said step axles on adjacent steps spaced apart a first distance in said landing zones; to hold adjacent outer ends of said step axles on adjacent steps spaced apart a second distance in said constant slope zone; and is operable to gradually change the distance between adjacent outer ends of said step axles from said first distance to said second distance in said entry transition zone, and return, in said exit transition zone by causing selected sliding movement between said selected links and said other links adjacent thereto in said outer step chain.

6. The escalator assembly of claim 5 wherein said cam path is formed on an outer side surface of said outer step track, and said cam followers are rollers which travel along said outer side surface of said outer step track.

7. The escalator assembly of claim 6 wherein said scissor means are links pivotally connected to said cam rollers and to adjacent outer step axles.

* * * * *